United States Patent [19]

Chen

[11] 4,355,530

[45] Oct. 26, 1982

[54] PUNCHING MACHINE FOR MAKING DIFFERENT PRODUCTS AT THE SAME STEP

[76] Inventor: Ho L. Chen, 480, Chang Sui Rd., Sec. 2, Fu An Tsun, Shu Sui Hsiang, Chang Hua, Taiwan

[21] Appl. No.: 212,259

[22] Filed: Dec. 2, 1980

[51] Int. Cl.[3] ..... B21J 9/18

[52] U.S. Cl. ..... 72/452; 72/455; 100/208

[58] Field of Search ..... 72/452, 404, 455, 399, 72/395, 450, 442; 100/208, 292, 209

[56] References Cited

U.S. PATENT DOCUMENTS

| | | | |
|---|---|---|---|
| 46,785 | 3/1865 | Dunning | 100/208 |
| 60,376 | 12/1866 | Howe | 100/208 |
| 77,108 | 4/1868 | Serrin | 100/208 |
| 3,064,559 | 11/1962 | Treer | 100/292 |
| 4,203,359 | 5/1980 | Baltschun | 100/209 |
| 4,216,713 | 8/1980 | Jung | 100/292 |

*Primary Examiner*—Gene Crosby

*Attorney, Agent, or Firm*—Larson and Taylor

[57] ABSTRACT

A press is disclosed having an upper set and a lower set of dies which open and close simultaneously during the operating cycle. An upright body frame member carries the lower die of each of the upper and lower sets of dies. A sliding member is mounted for reciprocal vertical movement and carries the top die for each of the upper and lower dies sets. The sliding member is provided with a recess for receiving an eccentric cam for actuating the slide.

4 Claims, 3 Drawing Figures

PUNCHING MACHINE FOR MAKING DIFFERENT PRODUCTS AT THE SAME STEP

BACKGROUND OF THE INVENTION

The current traditional style punching machine only locks a punch on the bottom surface of a sliding body. This sliding body is driven by fly-wheel and crank moved, in turn, by motor so as to make the sliding body following the crank to slide up and down for meeting with the punching-die locked on a bottom fixture. The fixture is located on the bottom seat of punching machine and does the punching work. This kind of single die punching operation not only influences the working efficiency on account of its slow speed of punching but also necessitates changing of the punch and punching-die set or use different punch and punching-die sets on separate punching machines for the two differnt kinds of punching work. Consequently, a lower working efficiency and increasing of investment amount as well as more space needed for placing a number of punching machines result.

Although one can adopt the compound die or combination die to traditional punching machine to promote working efficiency for products having the same specifications, these said two dies must be of high class quality, making it more expensive for users. In addition, such combination cannot still manage the procedure of angle-cutting and cutting-off operated on one punching machine at one time.

SUMMARY OF THE PRESENT INVENTION

So, the present invention is offered for eliminating the defects of traditional punching machine and provides a modified punching machine for the purpose of promoting working efficiency and operating the different kinds of work (like angle-cutting and cutting-off.. etc.) at one step.

In general, in one embodiment, the present invention uses motor, driving shaft, eccentric cam as a driving means or power source. Both of the bottom surfaces of a sliding body and the bottom surface of the horizontal portion of a bent plate, which is united with the side(s) of the top part of said sliding body, have a hole in the center. Therefore a punch can be set in each said hole. At the same time, both of the bottom seats of the body of the punching machine and the top part of two lead plates, which is united with two sides of the front part of the body punching machine have a fixture located in the central position. Therefore a punching-die can be locked in each said fixture. When the said sliding body slides up and down straightly by following the revolving eccentric cam in a central abdomen empty tank of the sliding body, both the top punch and the bottom punch mutually match with the top punching-die and the bottom punching-die. Therefore, the punching operation of the same or different specification of products can be made separately on the top and bottom portion of punching machine at one time in the same step.

The present invention is the punching machine to operate different punching procedures (like angle-cutting and cutting-off, etc.) at one step. It is a modification of the traditional punching machine which is driven by flying wheel, crank and motor. A top punch in addition to the original bottom punch is set in a hole at the central position of the bottom surface of the horizontal portion of a bent plate which is united with the side(s) of the top part of a sliding body. And at the same time, aside from the original bottom punching-die fixture, a top punching-die fixture can be set on the top part of two sliding lead plates which are united with two sides of the front part of the body of the punching machine. Therefore, when an eccentric cam drived by motor and driving shaft is revolving in the central abdomen empty tank of said sliding body, the sliding body can be moved to slide up and down straightly and steadily. As the result, the punching movement of top and bottom punch and punching-die sets can be finished at the same time.

DETAILED DESCRIPTION OF THE PREFERRED EMBODIMENTS

Figure 1:
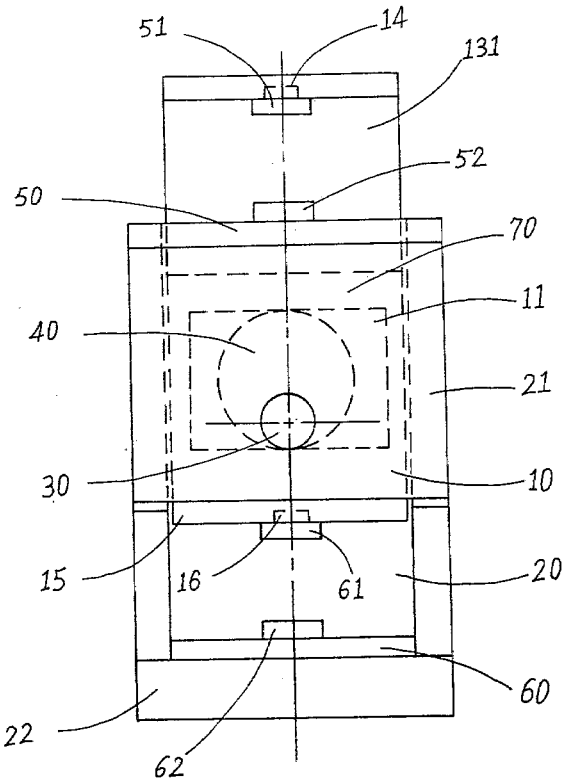
FIG. 1 the front view of the first practice example of this invention.
Figure 2:
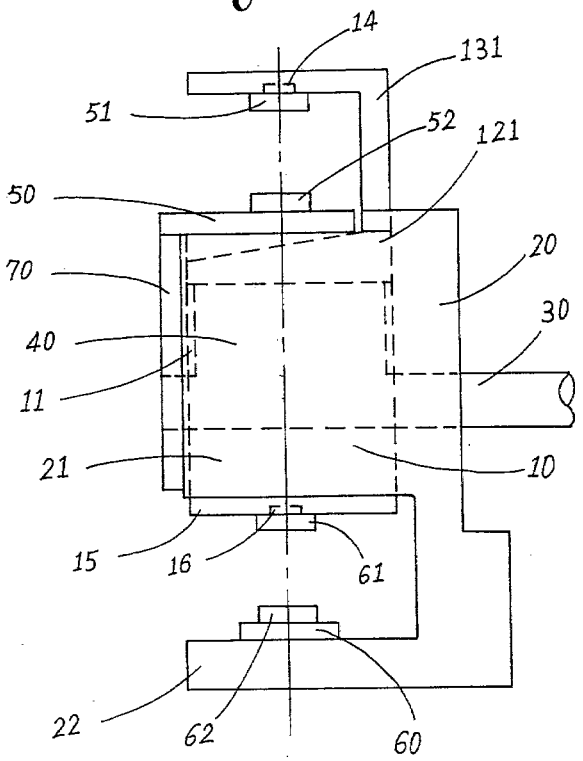
FIG. 2 the right side view of the first practice example of this invention.

The front view and the right side view of the first practice example of this invention is showed in FIG. 1 and FIG. 2. A sliding body 10 is set between two sliding lead plates 21 extended forwardly from two sides of the body 20 of the punching machine. An oblong shaped tank 11 is located in the central part of the abdomen of the sliding body 10 to accommodate an eccentric cam 40 driven by a driving shaft 30 and a motor (not shown). Cam 40 is mounted so when driving shaft 30 rotates the eccentric cam 40, the sliding body 10 will slide up and down along the lead grooves of the two sliding lead plates 21. The sliding distance is determined by the shape and size of the eccentric cam 40.

The back side 121 of the top part of the sliding body 10 extends upwardly to be an inverted "L" shaped plate 131. A hole 14 located in the center of the bottom surface of the top horizontal portion of said plate 131 can lock a top punch 51 in it. A second hole 16 is located in the center of the bottom surface 15 of the sliding body 10, and a bottom punch 61 is locked in it.

The body 20 of the punching machine is made of cast iron normally. Two sliding lead plates 21 with lead grooves extend forwardly from two sides of the main or rear part of the body 20 of the punching machine in order to receive and retain therebetween sliding body 10. The sliding body 10 can slide up and down in straight line steadily along with the lead grooves of said two sliding lead grooves of said two sliding lead plates 21. Thus is a similar arrangement to a traditional punching machine. Namely, a bottom fixture 60 is mounted on the top surface of the bottom seat 22 of the body 20 of the punching machine and a bottom punching-die 62 is locked in. Die 62 is located at the same central line but a little lower than the position of the bottom punch 61 locked in a hole 16 of the bottom surface 15 of the sliding body 10. The present invention however, also has its top fixture 50 mounted on the top parts of said two sliding lead plates 21 in order to set a top punching-die 52 in said top fixture 50. At the same central line but a little higher position there is a hole 14 for locking a top punch 51 that is located in the center of the bottom surface of the horizontal portion of plate 131 which extends from the back side of the top part of the sliding body 10.

Thus the central line of two sets of top and bottom punch and punching-die are in the same straight line. Therefore, when a driving shaft 30 and an eccentric cam 40 are revolved by a motor, the above-mentioned two sets of top and bottom punches and punching-dies have the function of punching at the same step by way of up and down straight movement of the sliding body 10. In order to maintain security during the process of punching, a front cover panel 70 is mounted on the front of two sliding lead plate 21 to avoid men's hand or clothing being rolled into the sliding body 10 of punching machine.

Figure 3:
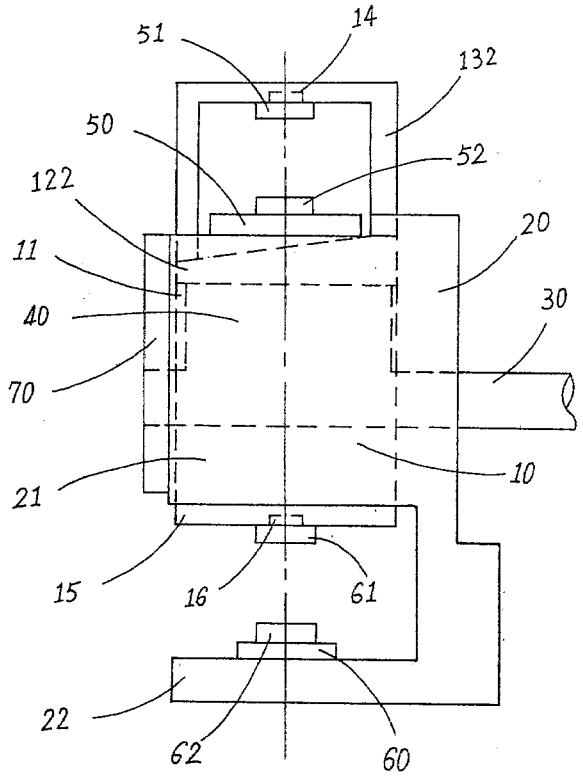
FIG. 3 the right side view of the second practice example of this invention.

As shown in FIG. 3 of right side view of the second embodiment of this invention, the main feature is to change the design of said plate 131 into an inverted "U" shaped plate 132 formed by extending upwardly and then horizontally bending to unit together from both the back side 121 and the front side 122 of the top part of the sliding body 10. Since the two sides of the plate 132 are united with the sliding body 10, more stability can be provided when heavy burden articles are punched.

In conclusions, owing to the top and bottom punch and punching-die sets owned by the invention can punch two different kinds of articles at the same step. Consequently, the production efficiency is twice that of traditional punching machine. Besides, the two top and bottom punch and punching-die sets can do the work of angle-cutting and cutting-off at the same time which can result in saving machines, plant space and promoting production efficiency. Besides, the difference of height of the top and bottom punch and punching-die sets is between 40 cm to 60 cm, so a single operator can handle these two punch and punching-die sets separately, and this can also have the effect of saving labor.

I claim:

1. A punching machine for making different products in the same cycle of operation comprising a driven shaft;

an eccentric cam driven by said driven shaft;

a normally upright body having two lead plates, a rear member with two sides united with said two lead plates, and a bottom seat located at the bottom of said body and having a horizontal section;

a sliding member mounted for reciprocal vertical movement on said lead plates, said sliding member having a central part with a recess for receiving and being driven by said eccentric cam, said sliding member having a top part with a horizontal portion that is extended above said central part, and said sliding member having vertically aligned holes, an upper hole at the center of the bottom surface of said top part horizontal portion for retaining a top punch and a lower hole in the bottom surface of said sliding member for retaining a bottom punch;

a first fixture for mounting a top punching-die and mounted at a central location in the top part of said machine body; and a second fixture for mounting a bottom punching-die and mounted on said bottom seat.

2. The punching machine as claimed in claim 1 wherein said sliding member top part includes an integral inverted "L" shaped plate that has a vertical back portion that extends upwardly from the back side of said sliding member central part and has said top horizontal portion extending forwardly.

3. The punching machine as claimed in claim 1 wherein said sliding member top part includes an integral inverted "U" shaped plate that has vertical forward and rearward portions that extend upwardly from said sliding member central part and said top horizontal portion extends between said forward and rearward portions.

4. The punching machine as claimed in claims 1, 2, or 3 and further including a front cover panel mounted in front of said two lead plates.

* * * * *